United States Patent [19]

Han

[11] 4,369,043

[45] Jan. 18, 1983

[54] PROCESS FOR THE PREPARATION OF HIGH OCTANE VALUE SUBSTITUTE FUEL FOR A SPARK IGNITION TYPE INTERNAL COMBUSTION ENGINE

[75] Inventor: U. Yeon Han, Inchon, Rep. of Korea

[73] Assignee: Korea Kef Oil Industrial Co., Ltd., Seoul, Rep. of Korea

[21] Appl. No.: 340,492

[22] Filed: Jan. 18, 1982

Related U.S. Application Data

[63] Continuation-in-part of Ser. No. 186,644, Sep. 12, 1980, abandoned.

[30] Foreign Application Priority Data

Feb. 27, 1980 [KR] Rep. of Korea ..... 804/76

[51] Int. Cl.[3] ..... C10L 1/18

[52] U.S. Cl. ..... 44/53; 44/66; 44/68; 44/77; 44/79

[58] Field of Search ..... 44/53, 56, 66, 77, 68

[56] References Cited

U.S. PATENT DOCUMENTS

| | | | |
|---|---|---|---|
| 1,504,837 | 8/1924 | Ricardo | 44/53 |
| 1,591,665 | 7/1926 | Esseler, Jr. | 44/53 |
| 3,902,868 | 9/1975 | Zoch, Jr. | 44/56 |

*Primary Examiner*—Jacqueline V. Howard
*Attorney, Agent, or Firm*—Fleit & Jacobson

[57] ABSTRACT

This invention relates to a fuel composition and process for making a fuel with high octane value for use in a spark ignition type internal combustion engine. More particularly, this invention relates to a process for preparing a substitute fuel composition comprising mixing 70.6% of a mixture of 65.0% methanol, 0.6% methanol+stearic acid (40:1) and 5.0% benzene, 20.4% of a mixture of 20.0% water, 0.3% dextrin and 0.1% phenol, 5% of combustion-accelerant consisted of 0.70% stearic methyl dichloride, 0.35% ethylene dichloride, 0.85% xylene, 0.02% lead acetate, 2.50% acetone and 0.57% aluminum stearate+acetone (1:40) as surfactant and 4.0% oxalic acid (1 Kg)+dimethyl ether (201) as antiknock agent; stirring said mixtures at 150–200 rpm for 2–3 minutes at 10°–40° C. and preserving them for 48–72 hours at room temperature.

2 Claims, No Drawings

PROCESS FOR THE PREPARATION OF HIGH OCTANE VALUE SUBSTITUTE FUEL FOR A SPARK IGNITION TYPE INTERNAL COMBUSTION ENGINE

This application is a continuation in part of Ser. No. 186,644 filed Sept. 12, 1980, now abandoned.

This invention relates to a fuel composition and process for making a fuel with high octane value for use in a spark ignition type internal combustion engine. More particularly, this invention relates to a process for preparing a substitute fuel composition comprising mixing 70.6% of a mixture of 65.0% methanol, 0.6% methanol+stearic acid (40:1) and 5.0% benzene, 20.4% of a mixture of 20.0% water, 0.3% dextrin and 0.1% phenol, 5% of combustion-accelerant consisted of 0.70% stearic methyl dichloride, 0.35% ethylene dichloride, 0.85% xylene, 0.02% lead acetate, 2.50% acetone and 0.57% aluminum stearate+acetone (1:40) as surfactant and 4.0% oxalic acid (1 Kg)+dimethyl ether (201) as antiknock agent; stirring said mixtures at 150-200 rpm for 2-3 minutes at 10°-40° C. and preserving them for 48-72 hours at room temperature.

The fuel according to the invention will have the same efficiency as gasoline without causing operating problems in the internal combustion engine. The raw materials for the fuel are readily available domestically, thereby avoiding the necessity to import fuels from abroad. Further, as the fuel produces no smoke when combusted, it prevents contamination of the natural environment.

Hitherto, many proposals have been made for preparing substitute fuel such as the fuel according to the invention. However, all these fuels are derived from the crude oil or the existing gasoline itself and have many faults. Namely, prior synthetic fuels based on the commercial gasoline have chemical and physical properties similar to those of the raw gasoline.

An object of this invention, therefore, is to provide a new fuel oil, eliminating the aforementioned drawbacks.

For reference, standards of gasoline which is commercially available will be illustrated as below:

| | | | (JIS K 2202-65; gasoline for automobiles) | | | | | | |
|---|---|---|---|---|---|---|---|---|---|
| | | | distillation (loss considered) | | | | | Cu-plate | vapor press. |
| type | octane value | reaction | 10% eff. temp. °C. | 50% eff. temp. °C. | 60% eff. temp. °C. | 70% eff. temp. °C. | residue vol % | corrosive (50° C., 3h) | (37.8° C., Kg/Km$^2$) |
| #1 | 95 | neutral | 70 | 125 | 180 | 205 | 2.0 | 1 | 0.45 |
| #2 | 85 | | | | | | | | 0.80 |

(1) The above prior gasoline should not be washed, but those in the range of 5/100-20 mg/100 ml may be washed with a prescribed solvent to afford a practical point, 5 mg/100 ml.

(2) Any of lead alkyl compounds may be used except for lead tetraethyl. The amount of the lead alkyl, when calculated as metallic lead, may correspond to the amount of lead in lead tetraethyl.

Fuel, in general, should be inactive to metallic materials of apparatus and/or equipment in which said fuel is used, and should not be stand in its moving and pumping. Also, due to the high vapor pressure, problems such as vaporization, saturation and the like must not occur. When starting or running the engine, ignitionability and combustionability must be excellent, but when the engine is shut down, the ignition should not continue due to residual pressure.

As previously described, substitute fuels, proposed to the present, are not valuable in light of economic considerations. The fuels could not be prepared and manufactured at a large scale and do not solve the problems in connection with smoke-production and public pollution. (3) Lead tetraethyl or other lead alkyl has a characteristic property, and, therefore, the fuel may be colored to indicate that it contains the lead component. This has no relation with octane value. For a reference, according to KSM 2612, 1478-12-12 gasoline has the following properties:

| | | | Distillation | | | | |
|---|---|---|---|---|---|---|---|
| | Octane Value | | 10% eff. temp. | 50% eff. temp. | 90% eff. temp. | | Cu-plate |
| type | Res. | Mor. | °C. | °C. | °C. | residue vol % | corr. |
| #1 | 95 | 87 | 70 | 125 | 190 | 2.0 | 1 |
| #2 | 91 | 83 | | | | | |
| #3 | 86 | 79 | | | | | |

| type | vapor press. (37.8° C. Kg/Km$^2$) | color when lead added | gum (mg/100ml) | lead tetra-ethyl (ml/l) | sulfur (wt %) | oxd. sta-bility (min) | water and ppt. (wt %) |
|---|---|---|---|---|---|---|---|
| #1 | 0.45 | colored | 5.0 | 0.3 | 0.01 | 480 | 0.01 |
| #2 | 0.85 | | | | | | |
| #3 | | | | | | | |

Note:
1. The upper limit of atmospheric pressure is 0.98 when used under cold climate.
2. Octane value was tested either by Research or Motor method.

| | | | |
|---|---|---|---|
| b.p.: | 64.5-64.65° C. | (760mm Hg) | In summer, vaporization and saturation can be controlled by added solvents. |
| | 8° C. | (50mm Hg) | |
| | −16° C. | (10mm Hg) | |
| m.p.: | −94.9° C. | | In winter, start operation is efficient. |
| s.g.: | 0.7924 (20/20° C.) | | |
| f.p.: | 12.2° C. (closed) | | Good startability. |

-continued

| | | |
|---|---|---|
| | 15.6° C. (open) | |
| vis-cosity: | 0.59CPS (20° C.) | Good flowability. |
| Combustion heat: | 183 kcal/MOI (gas) | Short heat may be supplied by |
| | 173 kcal/MOI (liquid) | second and third solvent. |

It has been found that benzene enhances the initial ignition efficiency of gasoline when it is added to the gasoline. Benzene has the following physical properties:

b.p.: 80.103° C.; m.p.: 5.506° C.; specific gravity: 0.87902 (20° C.); 0.87368 (25° C.); flammable point: −11.1° C.; viscosity: 0.6487 CPS (20° C.), 0.6028 (25° C.); combusion hear: 781.2 KCal/mol (gas), 783.4 KCal/mol (liquid). Dimethyl ether has the following properties:

b.p.: 56.2° C. (760 mm Hg), 56.1-56.5 (760 mm Hg), 56.24-56.5 (760 mm Hg); m.p.: −94.3° C., −94.6, −95.35; specific gravity: 0.7898; flammable point: −17°−16.2° C. (closed), −9°−10° C. (open); combustion heat: 426.8 kcal/mol.

As described above, the fuel of the invention can be composed by diluting a mixture of methanol, benzene, ether, dextrin and stearic acid, followed by admixing 5% by volume combustion accelerant to said diluted mixture.

The combined vapor pressure of the vapor-liquid of methanol-water build up by a composition thereof is generally set forth below:

| methanol (%) | temp. (°C.) | press. (mm Hg) | methanol (%) | temp. (°C.) | press. (mm Hg) |
|---|---|---|---|---|---|
| 100 | 18.7 | 45.3 | 50.4 | 15.5 | 27.7 |
| | 35.5 | 106.3 | | 40.6 | 117.5 |
| | 49.5 | 215.3 | | 60.1 | 301.4 |
| | 65.4 | 443.8 | | 70.3 | 473.4 |
| | 78.5 | 766.5 | | 80.5 | 720.0 |
| 87.7 | 17.4 | 35.9 | 33.13 | 21.15 | 85.1 |
| | 40.7 | 133.3 | | 40.9 | 107.1 |
| | 60.5 | 346.4 | | 60.45 | 281.6 |
| | 70.2 | 532.5 | | 70.4 | 436.7 |
| | 79.9 | 739.5 | | 80.25 | 654.0 |
| 68.12 | 18.1 | 34.2 | | | |
| | 40.5 | 123.0 | | | |
| | 60.7 | 327.8 | | | |
| | 70.4 | 509.7 | | | |
| | 80.5 | 768.7 | | | |

The mean composition of the vapor-liquid of dimethyl ether ($CH_3$—O—$CH_3$) and water, and ether and methanol, respectively, are shown in the following table.

| Ether (mol %) | | temp. | Ether (mol %) | | temp. |
|---|---|---|---|---|---|
| liq. phase | gas phase | °C. | liq. phase | gas phase | °C. |
| 0.0 | 0.0 | 100.0 | 50.0 | 85.1 | 59.8 |
| 1.0 | 27.9 | 92.0 | 60.0 | 86.3 | 59.2 |
| 2.5 | 47.0 | 84.2 | 70.0 | 87.5 | 58.8 |
| 5.0 | 63.0 | 75.6 | 80.0 | 89.7 | 58.2 |
| 10.0 | 75.4 | 66.9 | 90.0 | 93.5 | 57.4 |
| 20.0 | 81.3 | 62.4 | 95.0 | 96.2 | 56.9 |
| 30.0 | 83.2 | 61.1 | 97.5 | 97.9 | 56.7 |
| 40.0 | 84.2 | 60.3 | 100.0 | 100.0 | 56.5 |

Total pressure was 760mm Hg.

| Ether (mol %) | | temp. | Ether (mol %) | | temp. |
|---|---|---|---|---|---|
| liq. | gas | (°C.) | liq. | gas | (°C.) |
| 0.0 | 0.0 | 64.6 | 55.0 | 62.1 | 56.0 |
| 2.0 | 4.7 | 64.0 | 60.0 | 65.5 | 55.8 |
| 5.0 | 10.8 | 63.0 | 65.0 | 69.1 | 55.6 |
| 10.0 | 19.6 | 61.6 | 70.0 | 72.6 | 55.5 |

-continued

| | | | | | |
|---|---|---|---|---|---|
| 15.0 | 27.0 | 60.5 | 75.0 | 76.3 | 55.4 |
| 20.0 | 33.5 | 59.5 | 80.0 | 80.02 | 55.4 |
| 25.0 | 38.8 | 58.7 | 80.1 | 80.1 | 55.4 |
| 30.0 | 43.2 | 58.1 | 85.0 | 83.6 | 55.4 |
| 35.0 | 47.6 | 57.4 | 90.0 | 88.5 | 55.6 |
| 40.0 | 41.4 | 56.9 | 95.0 | 94.1 | 55.8 |
| 45.0 | 54.9 | 56.5 | 98.0 | 97.7 | 56.0 |
| 50.0 | 58.8 | 56.2 | 100.0 | 100.0 | 56.1 |

From the foregoing, the materials of the invention must be mixed at a predetermined ratio to achieve its boiling point of 30°-200° C., which is the same as that of the commercial gasoline. The mixing ratio will be the most important issue to solve the problems as described in the beginning of the description of the invention. Being mixed with methanol and water at an appropriate mixing ratio, benzene serves as explosive accelerant. Thus, the mixture has a good ignition power, although it is somewhat immiscible. Further, it is difficult to control its vapor pressure, and its heat amount is poor. However, if benzene is mixed with ether (R—O—R'), such as dimethyl ether and lead acetate, the mixture has a good flammable point and combustionable state. In other words, gasoline, when used in an internal combustion engine, is combined with air to obtain a combined gas mixture which is compressed, ignited and exploded to cause a reciprocal movement of piston. The engine is operated through a cycle of suction-compression-explosion-discharging.

Gasoline, as a compound consisting of carbon and hydrogen, can be obtained either from crude oil and/or coal and has high calories (11,000-11,500 calories per kg) and low specific gravity (0.67-0.76 at 15°-4° C.). In a composition consisted of methanol (flammable point: 15.6° C.; b.p.: 64.5° C.), benzene, dimethyl ether, xylene, and combustion accelerants, an approximately similar state may be achieved. When common gasoline is burned, oxygen (air) must consistently be supplied in order to build up a good combustion condition. To the contrary, the fuel of the invention produces oxygen during combustion the fuel, and, therefore, the use of the fuel will cause the lower output and starting spark due to the excess of air because the fuel does need lower wastage of air over gasoline.

The other components, dextrin and stearic acid, are used as modifiers. The surfactant is used as a cleaner of carburetor valve. An exemplary surfactant is acetone and aluminum stearate. An example of the fuel composition will be described below. All percentages are by volume unless otherwise stated.

| Sample | Components | Volume | Ratio |
|---|---|---|---|
| A | 1. Methanol | 65.0% | |
| | 2. Methanol + Stearic Acid (40:1 by wt.) | 0.6% | 70.6% |
| | 3. Benzene | 5.0% | |
| B | 1. Water | 20.0 | |
| | 2. Water + Dextrin | 0.3% | 20.4% |
| | 3. Phenol | 0.1% | |
| C | 1. Stearic Methyl Dichloride | 0.70% | |

-continued

| Sample | Components | Volume | Ratio |
|---|---|---|---|
| | 2. Ethylene Dichloride | 0.35% | |
| | 3. Xylene | 0.85% | |
| | 4. Lead Acetate | 0.02% | 5.0% |
| | 5. Acetone | 2.50% | |
| | 6. Aluminum Stearate + Acetone (1:40 by wt.) | 0.57% | |
| D | 1. Oxalic acid (1Kg) + Dimethyl Ether (202) | 4.0% | 4.0% |

The fuel of the invention is manufactured by mixing the above four mixtures. The fuel is tested as follows:

| types | heat amount | s.p. (°C.) | f.p. (°C.) | b.p. (°C.) | Cu-plate corrosive (50° C., 3h) |
|---|---|---|---|---|---|
| #1 | 7,000 cal | 18 | 15.1 | 63.8 | 0.5 |
| #2 | 8,000 cal | 19.5 | 15.6 | 64.1 | 1 |

What is claimed is:

1. A liquid fuel composition comprising in proportions by volume:
65.0% methanol;
0.6% stearic acid;
5.0% benzene;
20.0% water;
0.3% water+dextrin;
0.1% phenol;
5.0% of an accelerant comprising a mixture in proportions by weight of:
0.70% of stearic methyl dichloride,
0.35% ethylene dichloride,
0.85% xylene,
2.50% acetone and 0.57% aluminum stearate+acetone (1:40),
0.02% lead acetate; and
4.0% antiknocking agent comprising oxalic acid (1 Kg)+dimethyl ether (20 liters).

2. A process for preparing the fuel composition comprising:
65.0% methanol;
0.6% stearic acid;
5.0% benzene;
20.0% water;
0.3% dextrin;
0.1% phenol;
5.0% of an accelerant comprising a mixture in proportions by volume of:
0.70% of stearic methyl dichloride,
0.35% ethylene dichloride,
0.85% xylene,
2.50% acetone and 0.57% aluminum stearate+acetone (1:40),
0.02% lead acetate; and
4.0% antiknocking agent comprising oxalic acid (1 Kg)+dimethyl ether (20 liters); comprising the steps of:
(a) separately mixing the methanol, the stearic acid and the benzene;
(b) separately mixing water, the dextrin and the phenol;
(c) intermixing the mixtures obtained from steps (a) and (b);
(d) admixing the accelerant and the antiknocking agent with the mixture of step (c); and
(e) mixing the product of said step (d) to form a fuel composition.

* * * * *